United States Patent [19]

Bentley et al.

[11] Patent Number: 4,853,234

[45] Date of Patent: Aug. 1, 1989

[54] BEVERAGE PACKAGES

[75] Inventors: Andrew C. Bentley, Oxon; Christine A. King, Banbury; Alistair J. MacMahon, Brackley; Robert W. Tansley, Stratford-upon-Avon; Alec T. Newman, Banbury, all of United Kingdom

[73] Assignee: General Foods Limited, Banbury, England

[21] Appl. No.: 136,176

[22] Filed: Dec. 21, 1987

[30] Foreign Application Priority Data

Dec. 23, 1986 [GB] United Kingdom ..... 8630757

[51] Int. Cl.[4] ..... B65B 29/02

[52] U.S. Cl. ..... 426/77; 99/279; 99/295; 206/0.5; 426/82; 426/433

[58] Field of Search ..... 426/77, 82, 84, 106, 426/433, 435; 99/295, 279, 306; 206/0.5; 210/474, 497.2

[56] References Cited

U.S. PATENT DOCUMENTS 4,550,024 10/1985 le Granse ..... 426/77

FOREIGN PATENT DOCUMENTS 18325 of 1892 United Kingdom ..... 426/82

*Primary Examiner*—George Yeung

*Attorney, Agent, or Firm*—Linn I. Grim; Daniel J. Donovan

[57] ABSTRACT

A sealed beverage package containing one or more beverage ingredients and being formed from substantially air- and water-impermeable materials, the said package comprising a body portion having a compartment containing the beverage ingredients and a beverage outlet channel formed therein, the beverage outlet channel and the compartment of the body portion containing the beverage ingredients communicating in such a manner that, in use, the said compartment and the outlet channel co-operate to act as a filter during the preparation of a beverage from the package.

9 Claims, 5 Drawing Sheets

BEVERAGE PACKAGES

The present invention relates to beverage packages and, in particular, to sealed beverage packages which are formed from a substantially airand water-impermeable material and which contain one or more beverage ingredients.

The production of freshly brewed tea or coffee involves contacting tea leaves or roast and ground coffee with hot water and separating the beverage from the tea leaves or coffee grounds. Various methods for the production of freshly brewed coffee or tea are well known. For example, tea is prepared traditionally in a teapot, the tea leaves being immersed in boiling water and allowed to stand before being poured from the pot. Freshly brewed coffee may be prepared by the continuous passage of hot water through roast and ground coffee contained in a filter and the coffee collected in a jug or other receptacle, or by percolation which involves the continuous recycling of water through the roast and ground coffee.

It has previously been proposed to seal fresh roast and ground coffee or tea leaves in individual air-impermeable packages. For example, cartridges or capsules containing compacted ground coffee are known for use in certain coffee making machines which are generally termed "espresso" machines. In the production of coffee using these coffee machines the coffee cartridge is placed in a brewing chamber and hot water is generally caused to pass under pressure through the cartridge, thereby extracting the aromatic coffee constituents from the ground coffee and producing a coffee beverage.

Cartridges containing roast and ground coffee in which hot water flows under gravimetric force through the cartridge are also known. A cartridge of this general type is described in British Patent No. 1397116.

The cartridges for use in "espresso" machines and those through which water flows under gravimetric force contain a filter positioned beneath the charge of coffee. In the production of coffee from these cartridges water is generally injected into the coffee containing cartridge through a needle. The cartridge is filled with water which flows through the filter and is collected in a cup or other receptacle.

We have now developed a sealed beverage package containing one or more beverage ingredients which does not require the charge of the beverage ingredients to be placed above a conventional filter.

Accordingly, the present invention provides a sealed beverage package containing one or more beverage ingredients and being formed from substantially air- and water-impermeable materials, the said package comprising a body portion having a compartment containing the beverage ingredients and a beverage outlet channel formed therein, the beverage outlet channel and the compartment of the body portion containing the beverage ingredients communicating in such a manner that, in use, the said compartment and the beverage outlet channel co-operate to act as a filter during the preparation of a beverage from the package.

The body portion of the package of the invention may be provided with an inlet or an inlet may be formed in the package during use. In the embodiment where the inlet is formed in the body portion one or more inlet channels will preferably be provided which communicate with the inlet nozzle and with the compartment containing the beverage ingredients and assist in the distribution of water through the said compartment.

The body portion of the beverage package is preferably made from a rigid plastics material, such as polypropylene. The body portion may be coated with a thin layer of a barrier material, if desired, in order to improve the shelf life of the package.

The beverage package may be formed with a body portion which also acts as the bottom of the package. Alternatively, the body portion may be of an essentially hollow construction in which case the beverage package will have a flexible bottom portion sealed to the body portion adjacent the periphery of the bottom thereof.

Preferably the top portion of the package is made from a flexible material such as aluminium foil or a laminated material, such as a laminate comprising a metal layer laminated to a barrier layer of a plastics material. Many laminates of this type are known in the art and an example thereof is a polyester/aluminium/-polypropylene laminate. The optional bottom portion of the beverage package may also be formed from a material of this type.

In one embodiment of the invention the beverage outlet channel is provided in a flange which forms part of the body portion. It is preferred, in this embodiment of the invention, that the flange provided in the body portion should totally surround the compartment containing the beverage ingredients, although it is contemplated that this will not always be necessary. Furthermore, it is also preferred that the beverage outlet channel should extend in the flange around the whole of the periphery of the compartment containing the beverage ingredients. However, the present invention also includes within its scope beverage packages in which the beverage outlet channel extends in the flange only along a part of the periphery of the compartment containing the beverage ingredients. For example, if the beverage package is of elongate form then the beverage outlet channel may extend along the length of one long edge only.

In another embodiment of the invention a beverage outlet channel is formed along at least a part of the periphery of the compartment containing the beverage ingredients. for a package which is of elongate form a beverage outlet channel may be formed along one or both longitudinal edges of the compartment containing the beverage ingredients. Alternatively, or in addition, a beverage outlet channel may span the compartment containing the beverage ingredients.

The beverage package of the invention may be of any desired shape, although essentially round, rectangular or square packages are preferred. In an embodiment of the invention the package of the present invention preferably has an area which is adapted, when in use, to form an outlet for the beverage from the package. Alternatively, the body portion of the package may also have an outlet formed therein which communicates with the beverage outlet channel. The outlet of the package may be designed to be opened, in use, by the user for example, by means of tear springs, tear strips or peelable tabs. Alternatively, the package of the present invention may be designed for use with a machine in which the outlet of the package is opened automatically by cutting or piercing, or by the pressure of the water introduced into the package and from which the beverage is made. In the embodiment of the invention in which the package has a region which is intended, in use, to form an outlet for the beverage from the package a V-shape channel may be formed which communicates with the beverage outlet channel so that the beverage is funnelled into a narrow stream for collection in an appropriate cup or other receptacle.

The beverage outlet channel formed in the body portion and the compartment containing the beverage ingredients communicate in such a manner that, in use, the compartment and the beverage outlet channel cooperate to act as a filter during the preparation of a beverage from the package. This can be achieved in a variety of ways. For example, when the beverage outlet channel is formed in a flange which surrounds or at least partially surrounds the compartment containing the beverage ingredients, then the top portion of the package may be sealed not only to the body portion adjacent the periphery of the flange, but also at various points along the edge of the outlet channel which communicates with the said compartment. similarly, when the beverage outlet channel is formed along at least a part of the periphery of the compartment containing the beverage ingredients, the top portion of the package may be sealed to the body portion not only adjacent the periphery thereof, but also at various points along the edge of the outlet channel which communicates with the said compartment, for example by making appropriate spot welds of the top portion of the package package to this edge. The seals along the edge of the outlet channel may be formed by providing castellations in the edge to which the top portion can readily be sealed. In this manner, a plurality of very narrow channels or slots are provided connecting the compartment containing the beverage ingredients to the beverage outlet channel, thereby acting as a filter. It will be understood that the channels or slots should be of a size such that the majority of the roast and ground coffee particles are retained in the coffee bed. This will generally be achieved with castellation 0.2 to 0.5 millimetres high, depending upon the particular particle size of the coffee contained in the beverage package.

Alternatively, the dimensions of the various parts of the device may be so chosen that the top portion is sealed across the body portion in a relatively taut manner so that only a very narrow passageway remains connecting the compartment containing the beverage ingredients to the beverage outlet channel, thus acting as a filter.

When the body portion also acts as the bottom of the package it may be desirable to form one or more channels in the base of the compartment containing the beverage ingredients, in order to assist in the even distribution of the water used to make the beverage. Baffles may also be incorporated into the compartment containing the beverage ingredients, for example to prevent undue movement of insoluble beverage ingredients such as tea leaves therein, or to improve the water distribution for soluble powdered materials so that they dissolve more readily.

The beverage package of the present invention is designed, as discussed above, in order to incorporate a primary filter therein. This primary filter acts to retain at least the majority of any particles of insoluble beverage ingredients in the compartment containing the said ingredients. However, it may be desirable also to incorporate a secondary filter into the beverage package. In particular, when the beverage package contains leaf tea it may be difficult to prevent leaves of tea from escaping from the beverage compartment through the primary filter. Similarly, using a secondary filter for the preparation of coffee from roast and ground coffee enables any fine coffee particles which have passed through the primary filter to be collected and this results in coffee of less turbidity which may be preferred by the consumer.

A secondary filter may be positioned between the compartment containing the beverage ingredients and the beverage outlet channel, or immediately above the outlet from the package. The secondary filter may be formed from any conventional filter sheet material such as a cellulose, a spun-bonded polypropylene or a random weave polyester.

It is believed that a beverage package containing both a primary and secondary filter is novel and, accordingly, in a further aspect the present invention provides a sealed beverage package containing one or more beverage ingredients and being formed from substantially air-and water-impermeable materials, which package incorporates therein a primary filter which is formed by the particular mode of construction of the package and a secondary filter. The secondary filter is preferably formed from a conventional filter material.

When the beverage package contains roast and ground coffee, it may also be desirable to provide a layer of roast and ground coffee particles at the top of the compartment of such a size that they are too large to escape from the compartment into the filter channel. In this aspect of the invention it is preferred that this upper layer of coffee particles has a particle size in the range of from 100 micrometres to 1 millimetre.

The remainder of the package may be filled with a lower layer of ground coffee adjacent the first layer. The lower layer preferably has a particle size such that 98% by weight of the ground coffee passes a 75 micrometre mesh. The particles of the upper layer act essentially as a filter and prevent the very small particles of the lower layer of coffee from escaping from the package.

The roast and ground coffee of the upper layer is prepared by the dry grinding of roasted coffee beans to relatively coarse grounds which is a well known operation in the coffee industry.

The particle size distribution of the coffee particles of the lower layer of the coffee is preferably 9.9% less than 100 micrometres, 98% less less than 75 micrometres, 95% less than 60 micrometres, 90% less than 45 micrometres and 50% less than 20 micrometres.

It will be understood that the variety or blend of coffee beans which are fine ground to produce the coffee particles of the lower layer need not be the same as the variety or blend of coffee beans ground to produce the upper layer of coffee particles.

The package of the present invention, when filled with roast and ground coffee, preferably contains from 5 to 10 grams of roast and ground coffee, preferably about 7 grams for the preparation of a single cup. However, packages which are intended to provide multiple servings of coffee will contain an appropriate amount of roast and ground coffee, for example, packages intended to provide say five cups of coffee will contain from 20 to 50 grams of roast and ground coffee, preferably about 30 grams.

It will be understood that the very fine particles of ground coffee, which may be contained in a package in accordance with the present invention which contains roast and ground coffee, enable an improved extraction (i.e., higher yields) of the aromatic coffee constituents to be obtained from the roast and ground coffee. Alternatively, it is possible using a package of the present invention filled with roast and ground coffee as discussed above to reach a desired level of extraction of aromatic coffee constituents from the package in a shorter period of time.

The packages of the present invention are preferably flushed with an inert gas, such as nitrogen, prior to sealing and this ensures a long shelf life for the contents of the package.

The package may contain any desired beverage ingredients, for example, roast and ground coffee, leaf tea, chocolate powder and, according to individual taste, powdered milk or creamer, sugar and/or an artificial sweetener. Alternatively, the package may contain liquid beverage ingredients for one preparation of hot or cold beverages, for example a syrup concentrate from the preparation of a carbonated cold beverage therefrom.

It will be understood that it may be convenient for the compartment containing the beverage ingredients to be separated into two or more sections, for example, one section containing roast and ground coffee and another section containing powdered milk or creamer.

The present invention also includes within its scope a method for preparing a beverage which comprises positioning a sealed beverage package as described above at a brewing station, injecting water through water introduction means into the package, allowing the water to filter through the beverage ingredients contained in the package, allowing the beverage so-formed to filter into the beverage outlet channel and collecting the beverage so-formed through an outlet formed in the package.

The water is preferably injected into the beverage package under pressure, for example at a pressure of up to 150 psi (1034 KPa). For the preparation of hot beverages the water which is used for injection may either be boiling or may be at a temperature substantially below boiling and then be heated up during the beverage preparation, for example, by means of a heating element. For the preparation of cold beverages, the water which is used for injection will be cold or chilled. It is also contemplated that the package of the invention could contain ingredients for the preparation of carbonated beverages and in this case carbonated water will be injected into the package.

The water under pressure may be injected into the beverage package through an inlet formed in the package or through a slot of an appropriate size and shape formed, in use, in the base of the compartment containing the beverage ingredients. For example, a cruciform cut may be made in the base and water forced under pressure through the cut into the beverage package. The water injection may then be followed by compressed air in order to force the water through the package. It may also be convenient to be able to regulate the amount of water injected into the package so that a smaller quantity of a stronger beverage can be produced. For example it would be possible to inject a quantity of water sufficient for a half or whole cup of coffee, as desired. It may also be desirable to brew a small amount of a stronger beverage and then dilute this with a separate supply of water since this will avoid all of the volume of water having to pass through the package. To prepare a cup of coffee from a beverage package of the invention containing roast and ground coffee will take about 15 seconds and this is a very acceptable brewing time for the consumer.

It is also contemplated that a plurality of packages may be connected together in the form of a strip. In this embodiment of the invention the packages would preferably be attached to one another at the ends thereof. It will be understood that a line of weakness may be incorporated between adjacent packages during the manufacture thereof, this making the separation of individual packages from a strip a relatively easy matter. Furthermore, if desired several strips of the packages may be joined together along the longitudinal edges thereof to form a block of packages from which individual packages may be removed as desired.

The filled beverage package of the present invention, and the preparation of a beverage therefrom, will be further described by way of example and with reference to the accompanying drawings, in which.

Figure 1:
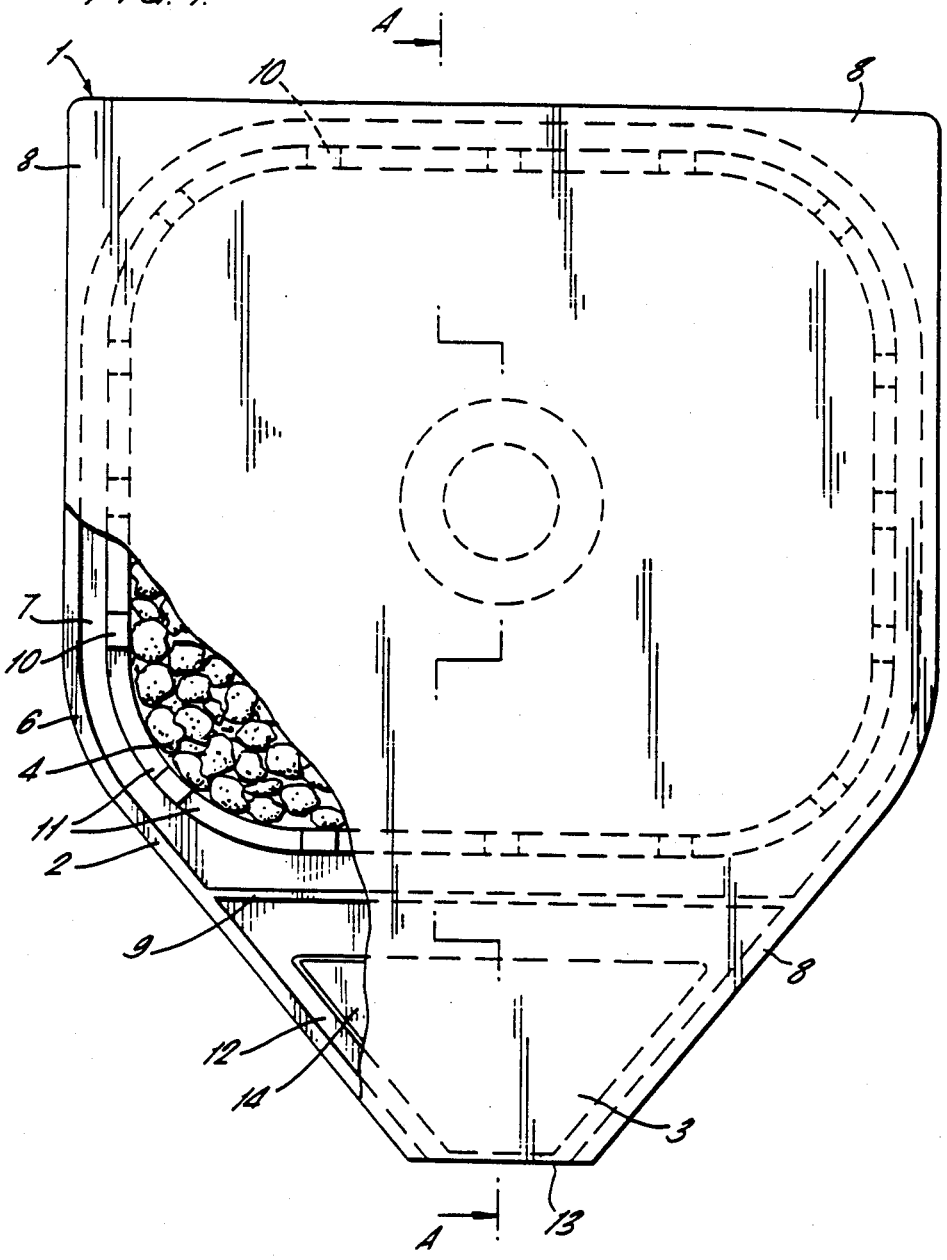
FIG. 1 is a top plan partially broken away view of a package in accordance with the invention.

Referring to the drawings a package 1 comprises a body portion 2 formed from rigid polypropylene and a top portion 3 which is formed from a laminated material. The body portion 2 has a compartment 4 which contains the beverage ingredients therein, in the embodiment as shown the beverage ingredient being roast and ground coffee particles. The compartment 4 is also provided with a recess 5 which is adapted for the injection of water under pressure therethrough. The body portion has a flange 6 formed around the compartment 4, the flange having a beverage outlet channel 7 formed therein. As best shown in FIG. 1, the top portion 3 is sealed to the body portion 2 around the periphery of flange 6, as shown generally at 8. The top portion is also sealed along rib 9 formed in the flange and to the crenellations 10 which are formed along the edges of the beverage outlet channel 7 which communicates with compartment 4. Slots 11 are thus formed by the space between the top portion 2 and the edge of the beverage outlet channel 7.

The package as shown is also provided with an essentially V-shape channel 12 which assists in collecting liquid during the preparation of the beverage. The V-shaped channel is formed in tab 14 which is, essentially, a triangular extension of the flange 6.

Figure 3:
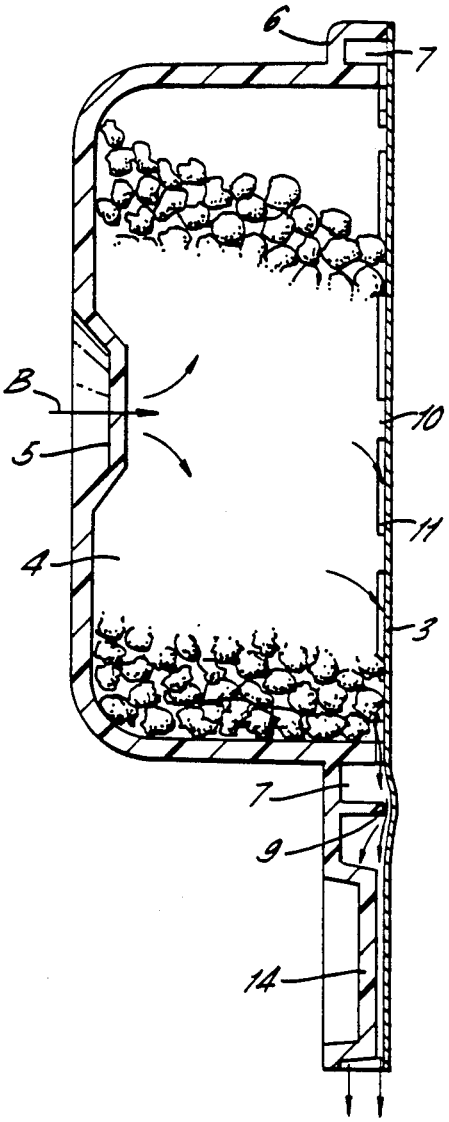
FIG. 3 is a section along the line A—A of FIG. 1 showing the manner in which a beverage is prepared therefrom.

In the preparation of a beverage from the package of the invention reference should be made to FIG. 3 in which the arrows marked on the drawing indicate the route which the water will take during passage through the bed of roast and ground coffee. Water is injected under pressure through recess 5 in the direction of arrow B through a cut or injection hole in the recess (not shown). The water under pressure contacts the roast and ground coffee and a coffee infusion is made therefrom. The coffee beverage then passes through slots 11 into the beverage outlet channel 7. The pressure of the beverage builds up in the beverage outlet channel and causes the seal formed between the top portion 3 and rib 9 to break. The beverage thus flows over rib 9 into the collection channel 12 which funnel the beverage to form a stream thereof which can be readily collected in a cup or other receptacle. It will be appreciated that at least the uppermost layer of the roast and ground coffee particles are of a size such that they cannot ingress through slots 11 into the beverage outlet channel 7.

Figure 4:
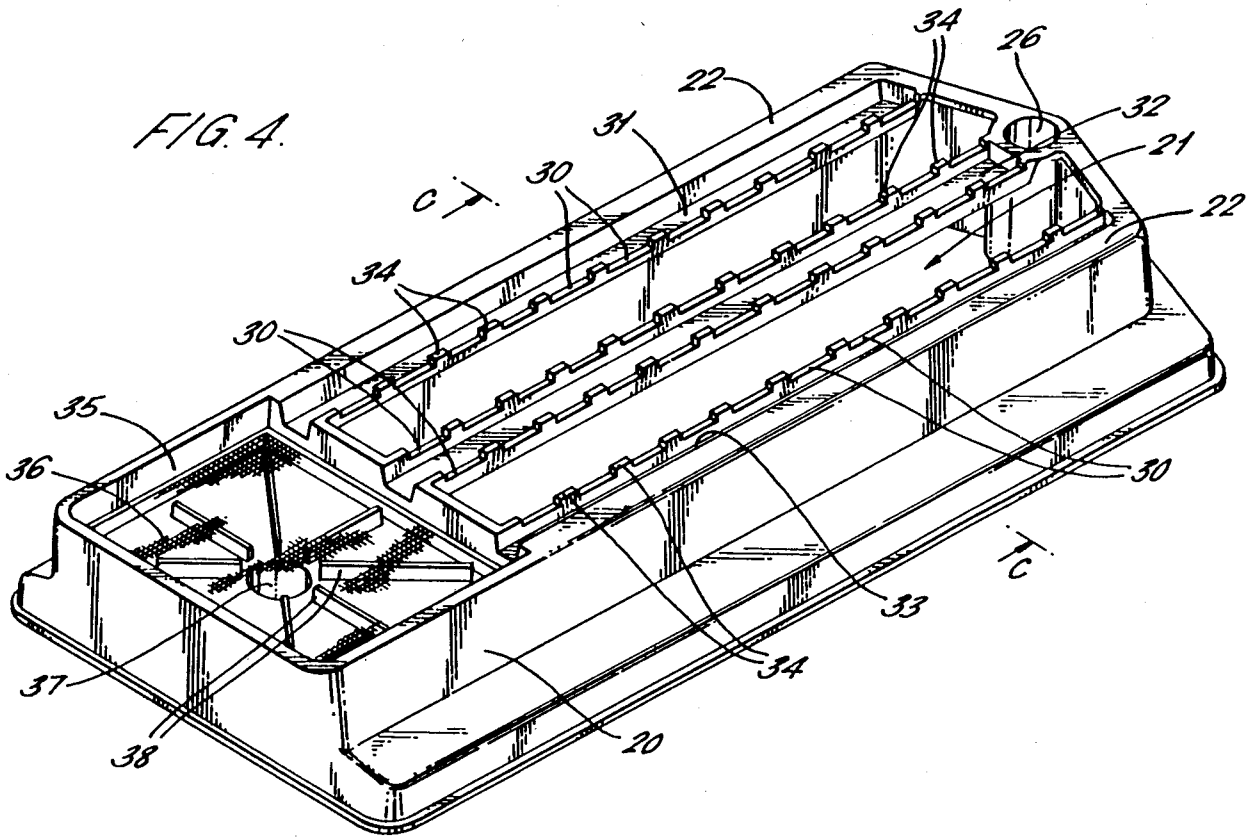
FIG. 4 is a perspective view of the topside of the body portion of another package in accordance with the invention.
Figure 5:
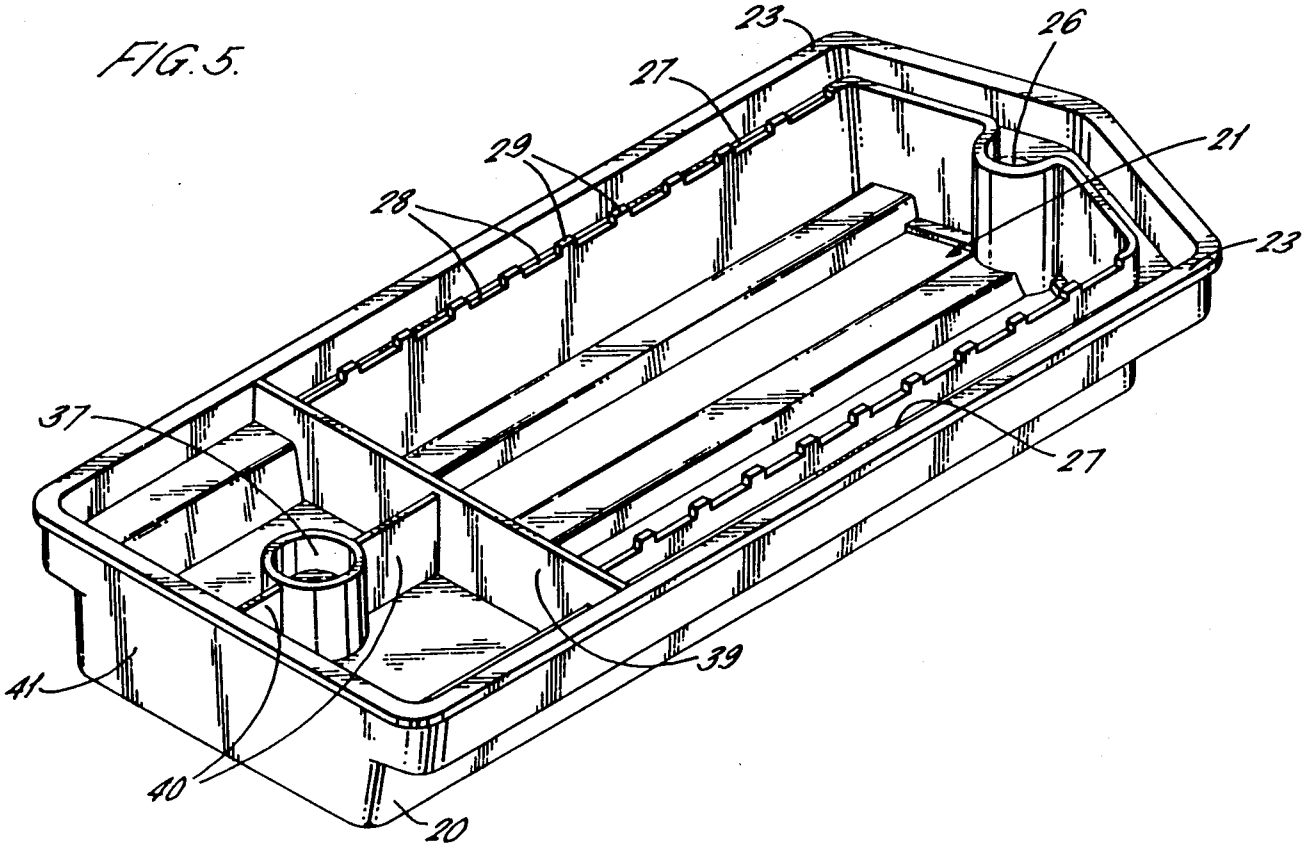
FIG. 5 is a perspective view of the underside of the body portion of FIG. 4.
Figure 6:
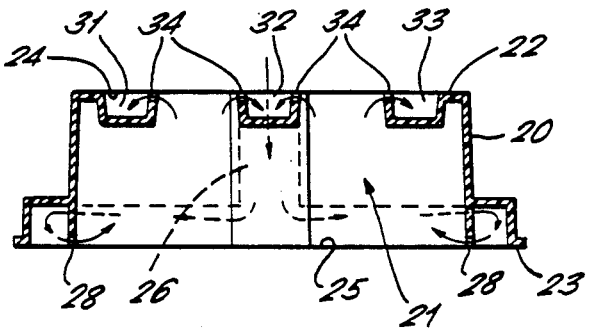
FIG. 6 is a section taken along the line C—C of FIG. 4 of a capsule incorporating the body portion of FIG. 4.

FIGS. 4, 5 and 6 illustrate an alternative embodiment of the package of the invention. Referring to these drawings, a body portion 20 is formed from a rigid plastics material such as polypropylene. The body portion comprises a compartment 21 which contains the beverage ingredients, for example roast and ground coffee particles (not shown). The body portion 20 has an upper edge 22 as shown in FIG. 4 and a lower edge 23 as shown in FIG. 5. In use a laminated foil is sealed both along the upper edge 22 of the body portion and the lower edge 23 of the body portion. The upper and lower laminated foils 24 and 25, respectively, are shown in FIG. 6. The body portion 20 is provided with an inlet 26 through which water is injected under pressure. The water passes via inlet 26 to an inlet channel 27 as is best shown in FIG. 5. The water passes through the slots 28 formed in the side wall of channel 27 into the bed 21 of roast and ground coffee. The slots 28 are separated one from another by castellations 29 which are also sealed to the lower foil 25. The water passes through the bed of beverage ingredients contained in compartment 21 and then filters through the slots 30 which are formed at the edge of the beverage outlet channels 31, 32 and 33, respectively. The slots 30 are separated one from another by castellations 34 which are sealed to the upper foil 24. A satisfactory primary filtration of roast and ground coffee particles having a mean particle size of 350 micrometres can be obtained when the slots 30 are separated by castellations 34 approximately 0.3 millimetres high.

The path of flow of the water through the package is illustrated in FIG. 6 by means of the arrows as shown on the drawing.

The beverage is collected via the beverage outlet channels 31, 32 and 33 via a collection chamber 35 which has a secondary filter 36 positioned above an outlet 37. The collection chamber 35 is strengthened by a plurality of ribs 38 positioned beneath filter 36 as shown in FIG. 4. The outlet 37 is separated from the beverage compartment 21 by means of a transverse wall 39. The outlet may also be strengthened by means of flanges 40 attached thereto which serve to space the outlet 37 from the wall 39 and the edge 41 of body portion 20.

Figure 2:
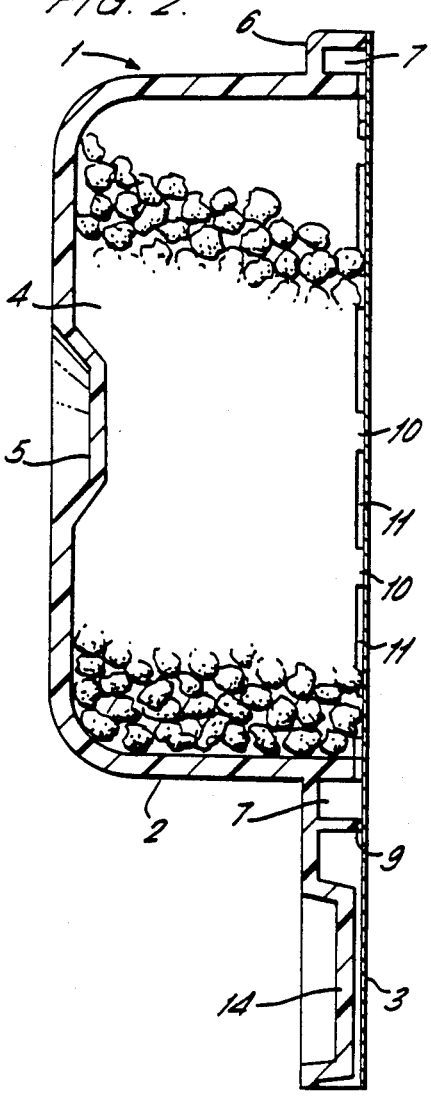
FIG. 2 is a section through the package of FIG. 1 taken along the line A—A.

It will be appreciated that in use the package shown in FIGS. 1 to 3 of the drawings will be positioned vertically and when used in this manner the tab 14 which has the V-shaped channel 12 formed therein will be lowermost. The water, preferably just below boiling point and preferably under pressure will be injected into compartment 4 horizontally through recess 5.

In the embodiment as shown in FIGS. 1 to 3 of the drawings the outlet from the package is formed by the rupture of the seal between the top portion 3 and rib 9. It will be appreciated, however, that in other embodiments of the invention the outlet could be formed by cutting or piercing the package either manually or automatically in an appropriately designed vending machine.

The shape of the package as shown in FIGS. 1 to 3 of the drawings is of particular advantage for use in an automatic vending machine since the tab portion 14 makes it easy to locate the package in an appropriate housing provided in the machine.

The package as shown in FIGS. 4 to 6 of the drawings is designed to be used horizontally and, when used in this manner, the outlet 37 will project downwards so that the beverage prepared may be collected in a cup or other receptacle.

It is also possible to inject different volumes of water into the package and this is of particular importance in relation to the preparation of coffee from roast and ground coffee particles. Thus it is possible to inject a small volume of water into the package containing roast and ground coffee in order to prepare an "espresso" cup of coffee, or alternatively to inject a larger quantity of water into the package containing roast and ground coffee and thus to prepare a standard cup of coffee. It will also be appreciated that packages can be produced which contain sufficient roast and ground coffee for the preparation of a larger quantity of coffee, for example several cups and is of particular importance in the catering trade.

What is claimed is:

1. A sealed beverage package containing one or more beverage ingredients and being formed from substantially air-and water-impermeable materials comprising:

(a) a body portion;

(b) a compartment within said body portion for holding beverage ingredients;

(c) an inlet channel for water flowing through said compartment;

(d) slots in said compartment; said slots of a specific size to maintain the beverage ingredients in said compartment;

(e) an outlet channel formed along at least part of the perhiphery of said compartment wherein liquid or beverage flows through said slots of said compartment into said outlet channel during the preparation of a beverage from the package; and (f) a collection chamber communicates with said outlet channel for collecting the liquid.

2. The beverage package of claim 1 wherein said body portion is made from rigid plastics material.

3. The beverage package of claim 1 wherein the top portion of said compartment is sealed with aluminum foil.

4. The beverage package of claim 1 wherein said outlet channels are formed along the longitudinal edges of said compartment.

5. The beverage package of claim 1 wherein said body portion is of an elongate construction and the outlet channels is formed along the longitudinal edges of said compartment.

6. The beverage package of claim 5 wherein the top portion of said package is sealed with a material to said body portion adjacent the periphery and along the upper edges of said outlet channel which communicates with said compartment containing said beverage ingredients.

7. The beverage package of claim 6 wherein the edge of the beverage outlet channel which communicates with said compartment containing the beverage ingredients has a plurality of castellations formed thereon onto which the top portion of air-and water-impermeable flexible material is sealed.

8. The beverage package of claim 6 which is sealed under an inert gas.

9. The beverage package of claim 5 wherein a filter is positioned within the collection chamber.

* * * * *